US009834428B2

(12) United States Patent
Dahl et al.

(10) Patent No.: US 9,834,428 B2
(45) Date of Patent: Dec. 5, 2017

(54) BEVERAGE DISPENSING SYSTEM

(75) Inventors: Benny Dahl, Odense S (DK); Kim Poul Knudsen, Middelfart (DK)

(73) Assignee: MICRO MATIC A/S, Odense SV (DK)

( * ) Notice: Subject to any disclaimer, the term of this patent is extended or adjusted under 35 U.S.C. 154(b) by 0 days.

(21) Appl. No.: 14/128,289

(22) PCT Filed: Jun. 27, 2012

(86) PCT No.: PCT/EP2012/062408

§ 371 (c)(1),
(2), (4) Date: Dec. 20, 2013

(87) PCT Pub. No.: WO2013/000932

PCT Pub. Date: Jan. 3, 2013

(65) Prior Publication Data

US 2014/0124543 A1 May 8, 2014

(30) Foreign Application Priority Data

Jun. 28, 2011 (DK) ..... PA 2011 70333

(51) Int. Cl.
*B67D 1/08* (2006.01)

(52) U.S. Cl.
CPC ..... *B67D 1/0848* (2013.01); *B67D 1/0832* (2013.01)

(58) Field of Classification Search
CPC .. B67D 1/0832; B67D 1/0838; B67D 1/0839; B67D 1/0848; Y10T 137/314; Y10T 137/6137

(Continued)

(56) References Cited

U.S. PATENT DOCUMENTS 3,937,246 A * 2/1976 Schots ..... B67D 1/0832 137/322
4,125,209 A * 11/1978 Bailey ..... B67D 1/0832 137/212

(Continued)

FOREIGN PATENT DOCUMENTS

AT 337031 6/1977
DE 102007005104 8/2008

(Continued)

*Primary Examiner* — Paul R Durand
*Assistant Examiner* — Charles P Cheyney
(74) *Attorney, Agent, or Firm* — Cozen O'Connor

(57) ABSTRACT

A beverage dispensing system for dispensing beverage from a beverage container, having a dispense head adapted to be connected to the beverage container. The dispense head having a housing having a through-going bore, and an activation handle pivotally mounted to the housing and movable between at least a deactivated position and an activated position. The beverage dispensing system further having a replaceable connection unit adapted to be connected with the dispense head and having a hollow piston member removably insertable into the bore of the housing and a dispensing line connected to the hollow piston member, whereby the hollow piston member is axially displaceable between a deactivated position and an activated position, and when in the activated position, the hollow piston member fluidly connects the extractor tube and the dispensing line to dispense beverage from the beverage container. The invention further relates to a connection unit for a beverage dispensing system, a dispense head for a beverage dispensing system, use of such dispense head as well as to a method for connecting and disconnecting the replaceable connection unit to a beverage container.

13 Claims, 17 Drawing Sheets

(58) Field of Classification Search
USPC ... 222/400.7, 397, 399, 394, 153.01–153.14; 137/212, 322, 614.04; 220/316, 319
See application file for complete search history.

(56) References Cited

U.S. PATENT DOCUMENTS

| | | | | |
|---|---|---|---|---|
| 4,291,821 | A * | 9/1981 | Nezworski | 222/153.04 |
| 4,305,421 | A * | 12/1981 | Fallon | 137/322 |
| 4,538,746 | A | 9/1985 | Hines | |
| 4,612,952 | A | 9/1986 | Fallon | |
| 4,736,926 | A * | 4/1988 | Fallon et al. | 251/149.9 |
| 4,834,266 | A * | 5/1989 | Brewer | B67D 1/0832 137/212 |
| 5,176,298 | A * | 1/1993 | Mogler et al. | 222/400.7 |
| 5,244,127 | A * | 9/1993 | Hubbard | 222/400.7 |
| 5,404,901 | A * | 4/1995 | Pickrell | B67D 7/0294 137/322 |
| 5,511,692 | A * | 4/1996 | Willingham | 222/1 |
| 5,944,229 | A * | 8/1999 | Rokkjaer | 222/153.07 |
| 6,105,825 | A * | 8/2000 | Gomi et al. | 222/146.6 |
| 6,598,768 | B2 * | 7/2003 | Celli | 222/400.7 |
| 8,678,247 | B2 * | 3/2014 | Haskayne | B67D 1/1411 137/170.1 |
| 2004/0045988 | A1 * | 3/2004 | van der Klaauw et al. | 222/400.7 |
| 2010/0308084 | A1 * | 12/2010 | Riis | B67D 1/07 222/400.7 |

FOREIGN PATENT DOCUMENTS

| | | |
|---|---|---|
| EP | 2014608 | 1/2009 |
| FR | 2059613 | 6/1971 |
| WO | WO 2009/036759 | 3/2009 |

* cited by examiner

BEVERAGE DISPENSING SYSTEM

CROSS REFERENCE TO RELATED APPLICATIONS

This is a U.S. national stage of application No. PCT/EP2012/062408, filed on Jun. 27, 2012. Priority is claimed on Demark Application No.: DK-PA201170333 filed Jun. 28, 2011 the content of which is incorporated herein by reference.

FIELD OF THE INVENTION

The present invention relates to a beverage dispensing system for dispensing beverage from a beverage container, the beverage dispensing system comprising a dispense head adapted to be connected to the beverage container and comprising a housing having a through-going bore, and an activation handle pivotally mounted to the housing and movable between at least a deactivated position and an activated position. The invention further relates to a connection unit for a beverage dispensing system, a dispense head for a beverage dispensing system, use of such dispense head as well as to a method for connecting and disconnecting the replaceable connection unit to a beverage container.

BACKGROUND ART

As a general tendency in society, the quality of foodstuff, including beverages, is of increasing importance. The quality of dispensed beverages, such as beer, has become of significant importance to the consumer and beer consumers tend to choose the beer label based on the view of the final impression, i.e. the dispensed beer. Furthermore, beer dispensing devices have become within the reach of ordinary consumers, i.e. more people have beer dispensing devices in their homes, at their firms, at sports facilities etc., where no trained personnel is operating the dispensing devices. Similarly, the safety of the user of the dispensing device and the hygiene of the device have also become very important.

When dispensing beverage, such as beer, in a bar facility, it may sometimes be difficult for the user, trained or untrained, to clean the device properly, or it might just be of low priority. Furthermore, often during replacement of the beverage container, the dispensing line is being reused without being cleaned properly. The consequence is that the dispensing line may contain old beverage and that for instance bacteria are present. This may provide a bad taste to the beverage, or even in some instances health disadvantages for the consumer.

Thus, there is a need for an easily operated dispensing system, which reduces the resources and skills involved when operating, replacing and cleaning the system. At the same time, the system has to provide high quality dispensed beverage and observe and fulfill the hygiene and safety regulations fixed by law.

SUMMARY OF THE INVENTION

It is an object of the present invention to wholly or partly overcome the above disadvantages and drawbacks of the prior art. More specifically, it is an object to provide an improved beverage dispensing system wherein the need for cleaning and service is reduced.

The above objects, together with numerous other objects, advantages, and features, which will become evident from the below description, are accomplished by a solution in accordance with the present invention by a beverage dispensing system for dispensing beverage from a beverage container, the beverage dispensing system comprising:

- a dispense head adapted to be connected to the beverage container and comprising;
  - a housing having a through-going bore, and
  - an activation handle pivotally mounted to the housing and movable between at least a deactivated position and an activated position,
- an extractor tube being inserted in the beverage container and comprising a riser;

wherein the beverage dispensing system further comprises:

- a replaceable connection unit adapted to be connected with the dispense head and comprising:
  - a hollow piston member removably insertable into the bore of the housing, and
  - a dispensing line connected to the hollow piston member, whereby the hollow piston member is axially displaceable between a deactivated position and an activated position, by moving the activation handle, and when in the activated position, the hollow piston member fluidly connects the extractor tube and the dispensing line to dispense beverage from the beverage container.

Hereby, a beverage dispensing system may be achieved wherein the hollow piston member and the beverage dispensing line can be periodically replaced, e.g. when the beverage container is empty.

In one embodiment the replaceable connection unit may be disposable and adapted for one time use.

By only subjecting disposable components to contact with the beverage, the hygiene of the system may be improved and the need for service and cleaning may be reduced. Better hygiene may result in beverage of a higher quality and a better taste. By replacing the hollow piston member and the dispensing line, i.e. the entire flow path being in contact with the dispensed beverage, less or no service may be required for the beverage dispensing system. Using disposable components may eliminate the need for cleaning these components, and consequently the risk of insufficient or erroneous cleaning. Further, the system according to the invention may be used in combination with various existing beverage dispensing systems, beverage containers and extractor tubes. The system may only require a dispense head adapted to receive a replaceable hollow piston member. Thus, the system may not require replacement of existing equipment, consequently reducing substantial investments in new equipment.

In one embodiment, the hollow piston member may define a fluid channel extending between a first end and a second end of the hollow piston member, and the hollow piston member may comprise a protrusion protruding from the second end of the hollow piston member in an axial direction, the protrusion having a flange adapted to be connected with the activation handle of the dispense head.

In another embodiment, the activation handle may comprise a gripping element pivotally mounted to the housing, the gripping element comprising at least one protruding leg being adapted to receive the protrusion and entering into engagement with the hollow piston member.

Further, the hollow piston member may comprise a mechanism preventing reuse of the replaceable connection unit by blocking the fluid channel and/or changing the geometry of the hollow piston member, the mechanism being activated when the hollow piston member is moved from the activated position to the deactivated position.

Also, the hollow piston member may comprise a check valve arranged in the fluid channel, the check valve comprising a preloaded spring and a pivotally mounted blocking member, wherein the blocking member may be rotated by the spring member when the check valve is activated by rupturing a fixation element.

Additionally, the check valve may be activated when the hollow piston member is moved from the activated position to the deactivated position.

Furthermore, the hollow piston member may comprise an axially displaceable insert connected with the second end of the hollow piston member, the insert being displaceable in a direction away from the first end of the hollow piston member and constituting the second end of the hollow piston member.

Hereby, the hollow piston member may be prolonged when the activation handle is moved from the activated position to the deactivated position, and the activation handle may not move back into the activated position, thereby preventing reuse of the replaceable connection unit.

In one embodiment, the hollow piston member may be made from a polymer material.

Further, the hollow piston member may comprise a use-indicator indicating if the replaceable connection unit has been connected to a beverage container, wherein the use-indicator may be a circumferential rim releasably connected to the second end of the hollow piston member, so that the circumferential rim may break off when the hollow piston member is moved in an axial direction in relation to the housing.

Also, the hollow piston member may, when removably inserted into the bore, be enclosed by the housing of the dispense head.

Additionally, the hollow piston member may be inserted into or removed from the bore, when the activation handle is moved into a first position.

In one embodiment, the activation handle may comprise an opening having a minimum diameter substantially equal to a maximum diameter of the hollow piston member.

In another embodiment, the opening in the activation handle may have a minimum diameter which is substantially equal to a maximum diameter of a valve mounted in an end of the dispensing line opposite the hollow piston member.

Furthermore, the invention relates to a connection unit for a beverage dispensing system according to the invention, the connection unit comprising:

- a hollow piston member defining a fluid channel extending between a first end and a second end of the hollow piston member, and
- a dispensing line connected to the second end of the hollow piston member and in fluid communication with the fluid channel, and
- a mechanism preventing reuse of the connection unit by blocking the fluid channel and/or changing the geometry of the hollow piston member.

Moreover, the connection unit may be packed in a sealed or sterile packing prior to being connected with the dispense head.

Additionally, the invention relates to a dispense head for a beverage dispensing system, the dispense head comprising:

- a housing having a through-going bore, and
- an activation handle pivotally mounted to the housing and movable between at least a deactivated position and an activated position.

In one embodiment, the dispense head may further comprise a gas inlet arranged in the housing, which, via a gas bore, may be in fluid communication with a space extending between the housing and the hollow piston member, the gas bore extending through a valve bore wherein a gas valve may be arranged to control the supply of gas from the gas inlet to the space.

In another embodiment, the gas valve of the dispense head may comprise a valve piston pivotally connected to a first end of the activation handle, a spring member forcing the valve piston towards a bottom of the valve bore, and a valve gasket arranged around a lower part of the valve piston to provide a gas-tight seal.

In one embodiment, the dispensing valve may comprise a spring-loaded movable valve member, and when the housing of the dispense head is connected to the beverage container and the activation handle is in the activated position, the hollow piston member and the first end of the activation handle may be pushed in a direction away from the beverage container by the spring-loaded movable valve member, whereby the valve piston of the gas valve may be displaced in an axial direction away from the bottom of the valve bore to open the gas valve.

By the gas valve only being open when the dispense head housing is connected to the beverage container and the activation handle is in the activated position, the $CO_2$ supply through the gas bore may be automatically disabled when the connection between the hollow piston member and the beverage dispensing valve is disconnected. The $CO_2$ supply may thus remain open and connected to the dispense head when the dispense head is removed from the beverage container, and when the hollow piston member is removed from the dispense head housing.

The invention also relates to the use of a dispense head and a connection unit in a beverage dispensing system, wherein the beverage container may be an A-system, a G-system, an S-system, a D-system, an M-system, a U-system or an L-system beverage container.

Furthermore, the invention relates to a method for connecting a replaceable connection unit to a beverage container according to the invention, the method comprising the steps of:

- connecting a dispense head to the beverage container,
- inserting a hollow piston member of the replaceable connection unit in a bore of a dispense head,
- connecting a gripping element extending from an activation handle to a protrusion provided on the hollow piston member by moving the activation handle from a first position to a second position, and
- moving the activation handle from the deactivated position to the activated position, whereby the hollow piston member is pushed against a spring-loaded movable valve member and into the beverage container.

The method according to the invention may further comprise the steps of taking at least part of the replaceable connection unit through an opening in the activation handle.

Moreover, the invention relates to a method for disconnecting a replaceable connection unit connected to a beverage container according to the invention, the method comprising the steps of:

- activating a check valve arranged in a fluid channel defined by the hollow piston member by moving the activation handle from the third to the second position,
- breaking off the connection between the gripping element of the activation handle and the protrusion on the hollow piston member by moving the activation handle between the second and the first position, and
- removing the hollow piston member from the bore of the housing.

This method may further comprise the step of closing a gas valve by moving the activation handle from the third to the second position.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
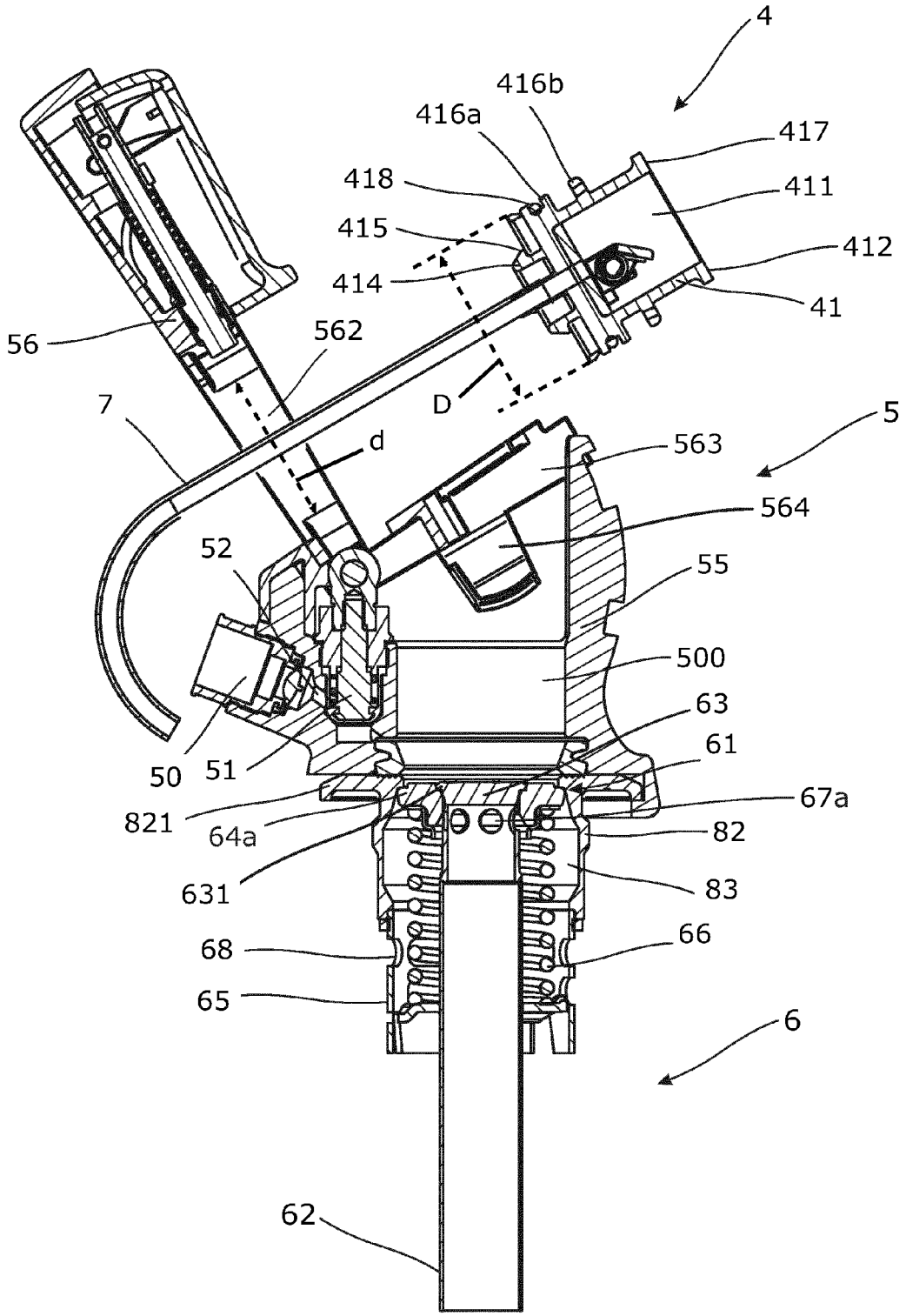
FIG. 1 shows a dispense head connected with an extractor tube and a replaceable connection unit extending through an opening in an activation handle of the dispense head.
Figure 7:
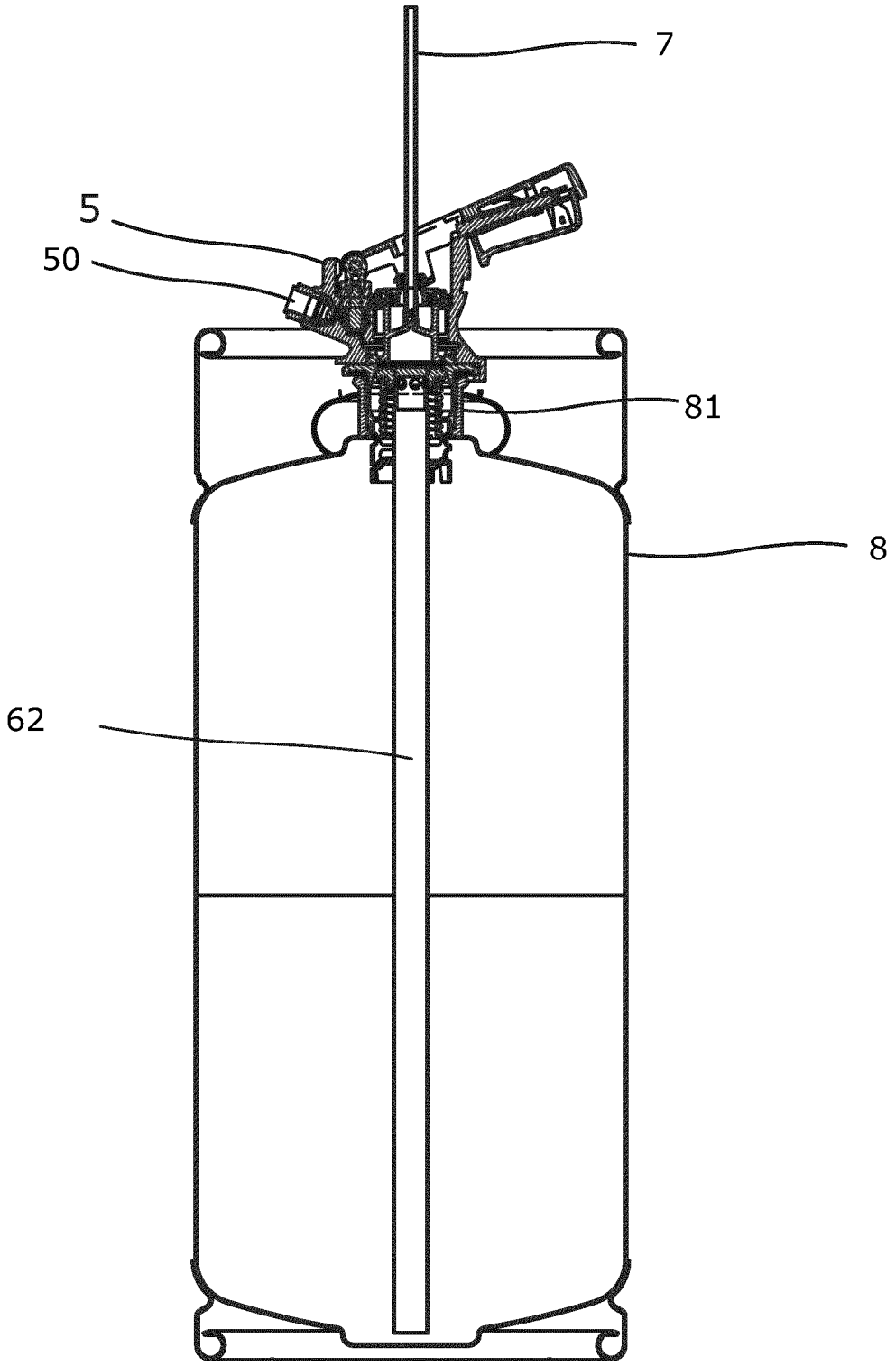
FIG. 7 shows a dispense head connected with a beverage container.
Figure 8:
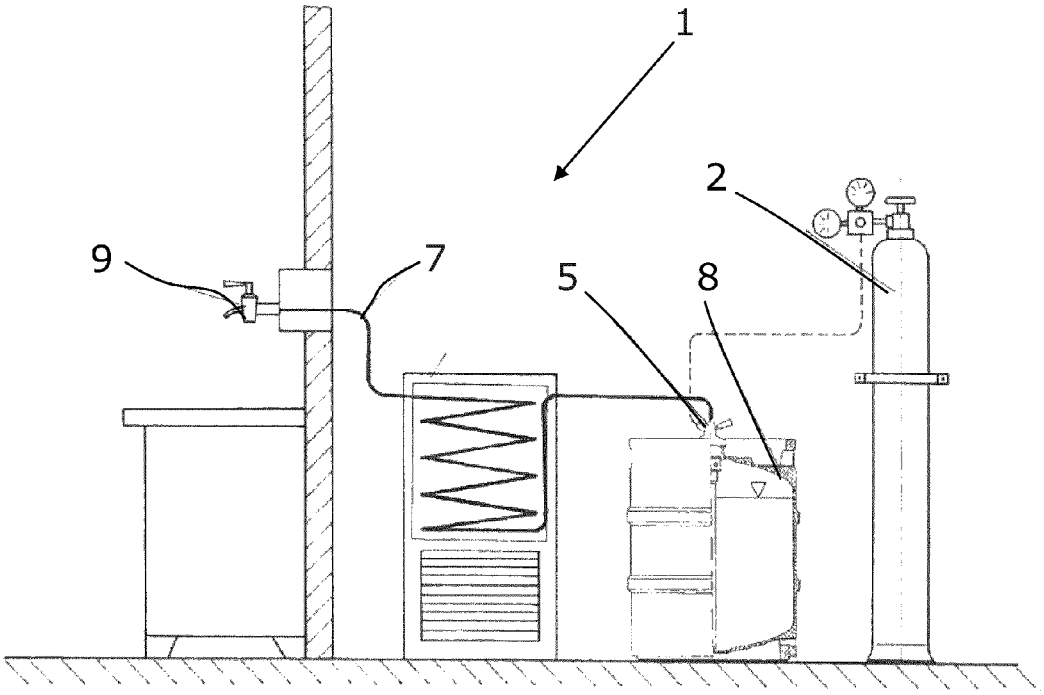
FIG. 8 shows a dispensing system.

Referring to FIG. 1, FIG. 7 and FIG. 8, a beverage dispensing system according to an embodiment of the invention will be described in the following. The beverage dispensing system comprises a replaceable connection unit 4, a dispense head 5 connected with a beverage container 8, and an extractor tube 6 arranged in the beverage container, such as a keg. When connected with the beverage container, the dispense head is in fluid communication with the extractor tube.

The beverage container comprises a neck 81 and a housing 82 connected with the neck. The extractor tube 6 is screwed into or by other means inserted into the neck 81 of the beverage container. The extractor tube comprises a riser 62 and a skirt 65, which, together with the housing 82, define a chamber 83. The riser extends substantially from a bottom of the beverage container 8 to a top of the housing 82. The extractor tube further comprises a dispensing valve 61 arranged at the top of the riser 62. The dispensing valve 61 provides a seal for the chamber 83, and hence for the beverage container, and is comprised by a stationary valve member 63 and a movable valve member 64*a*. The movable valve member is connected to a spring member 66 forcing the movable valve member 64*a* upwards towards a narrowing upper part of the housing 82 and an outwardly protruding flange 631 on the stationary valve member. When the movable valve member is pressed against the housing and the stationary valve member, the inner space of the beverage container is sealed off.

Figure 10:
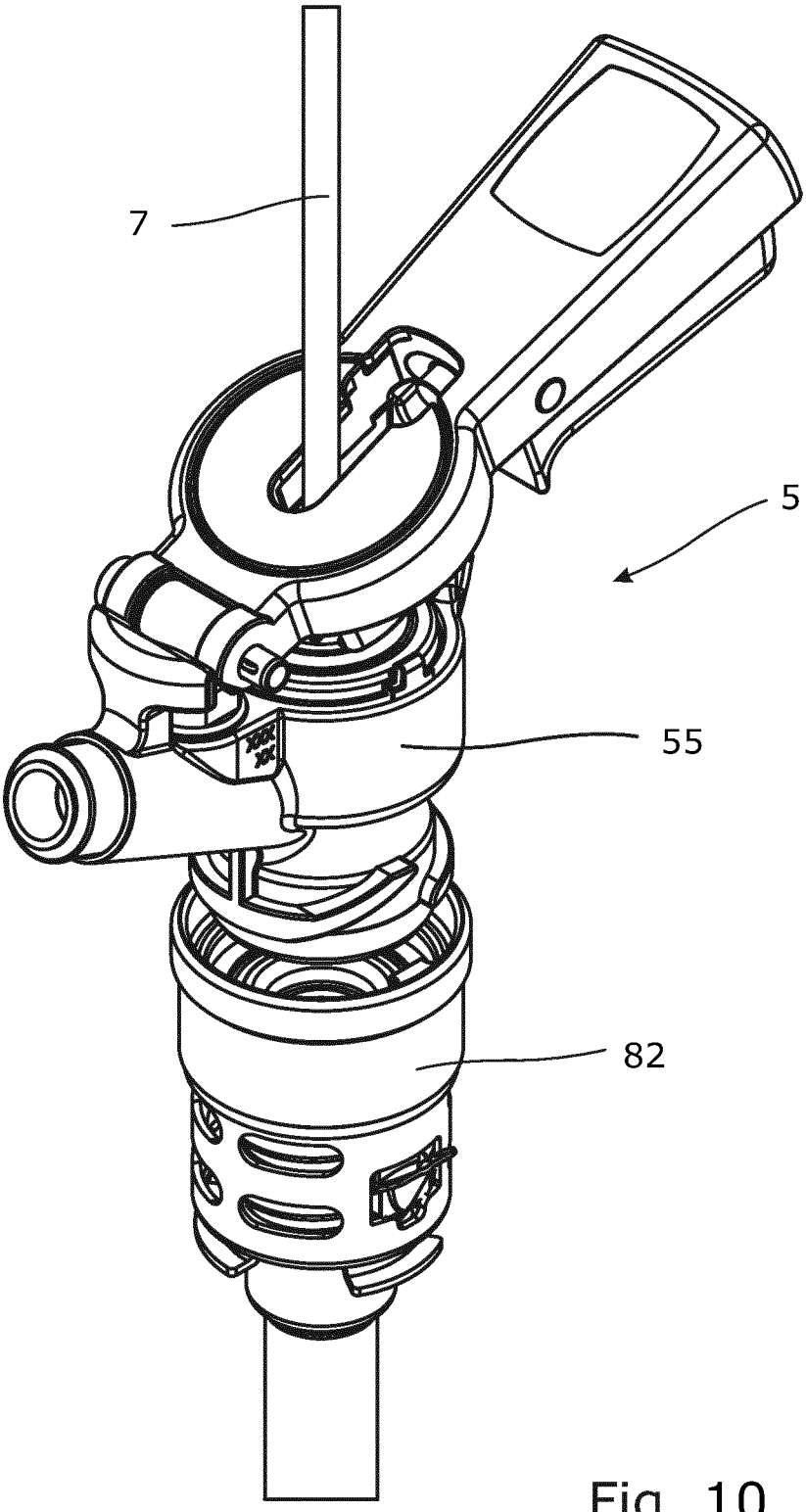
FIG. 10 shows a dispense head and an extractor tube comprising a bayonet connection.
Figure 11:
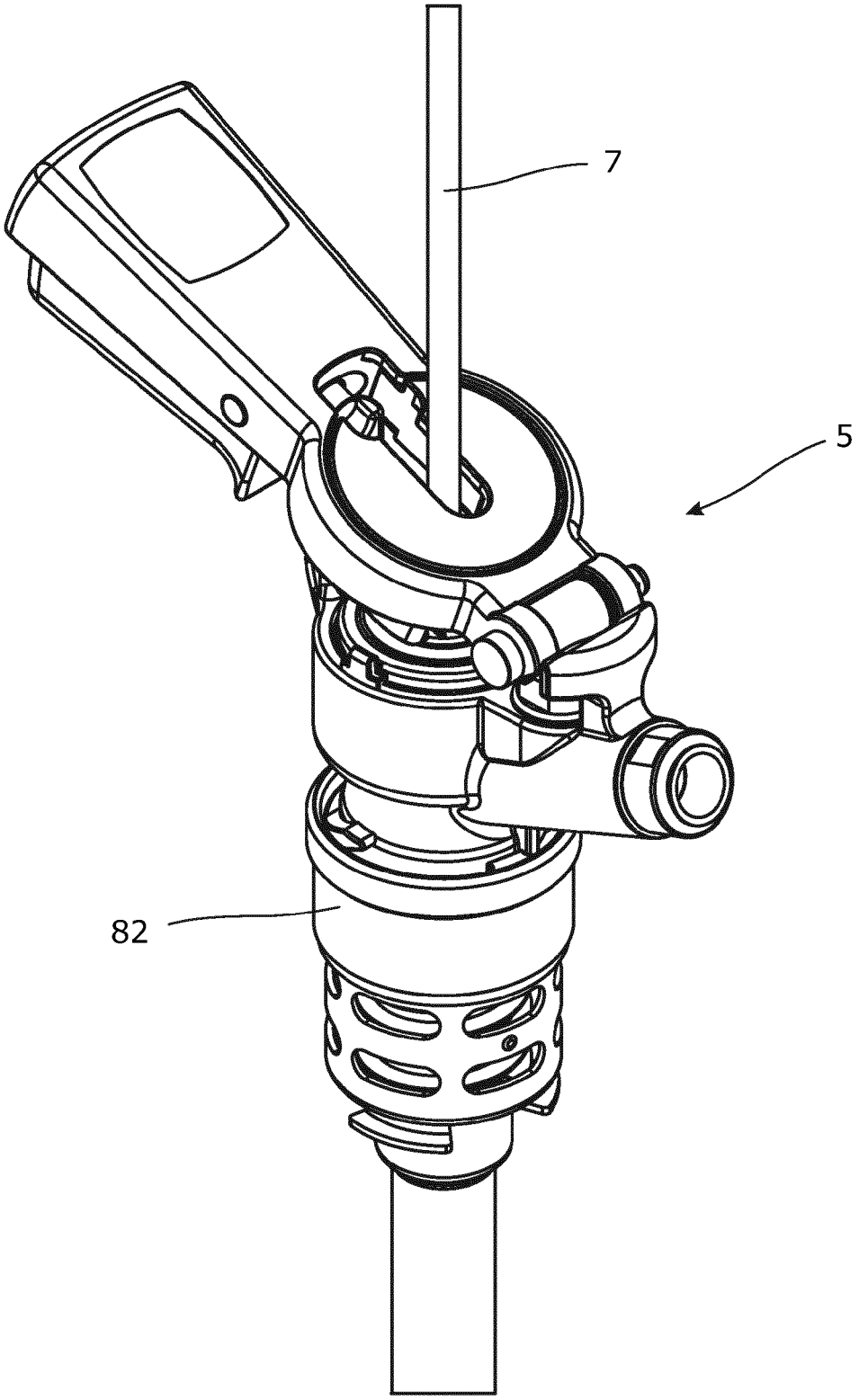
FIG. 11 shows the embodiment of FIG. 10, with the dispense head connected to the extractor tube.

The dispense head comprises a dispense head housing 55 connected to an outwardly extending flange 821 of the housing 82. The flange 821 is received in a horseshoe-shaped groove 550 provided in a bottom part of the dispense head housing 55, so that the dispense head may be slid onto the housing. When the flange 821 is arranged in the groove 550, the dispense head is connected to the beverage container 8 and prevented from moving in an axial or upwards direction away from the beverage container. The dispensing head housing may also be connected to the beverage container 8 in a number of other ways known to the person skilled in the art. The dispensing head housing may for example be connected to the beverage container using a bayonet connection as shown in FIG. 10. The dispensing head may thus be used in connection with a number of different systems such as A-systems, G-systems, S-systems, D-systems, M-systems, U-systems or L-systems.

Figure 3A:
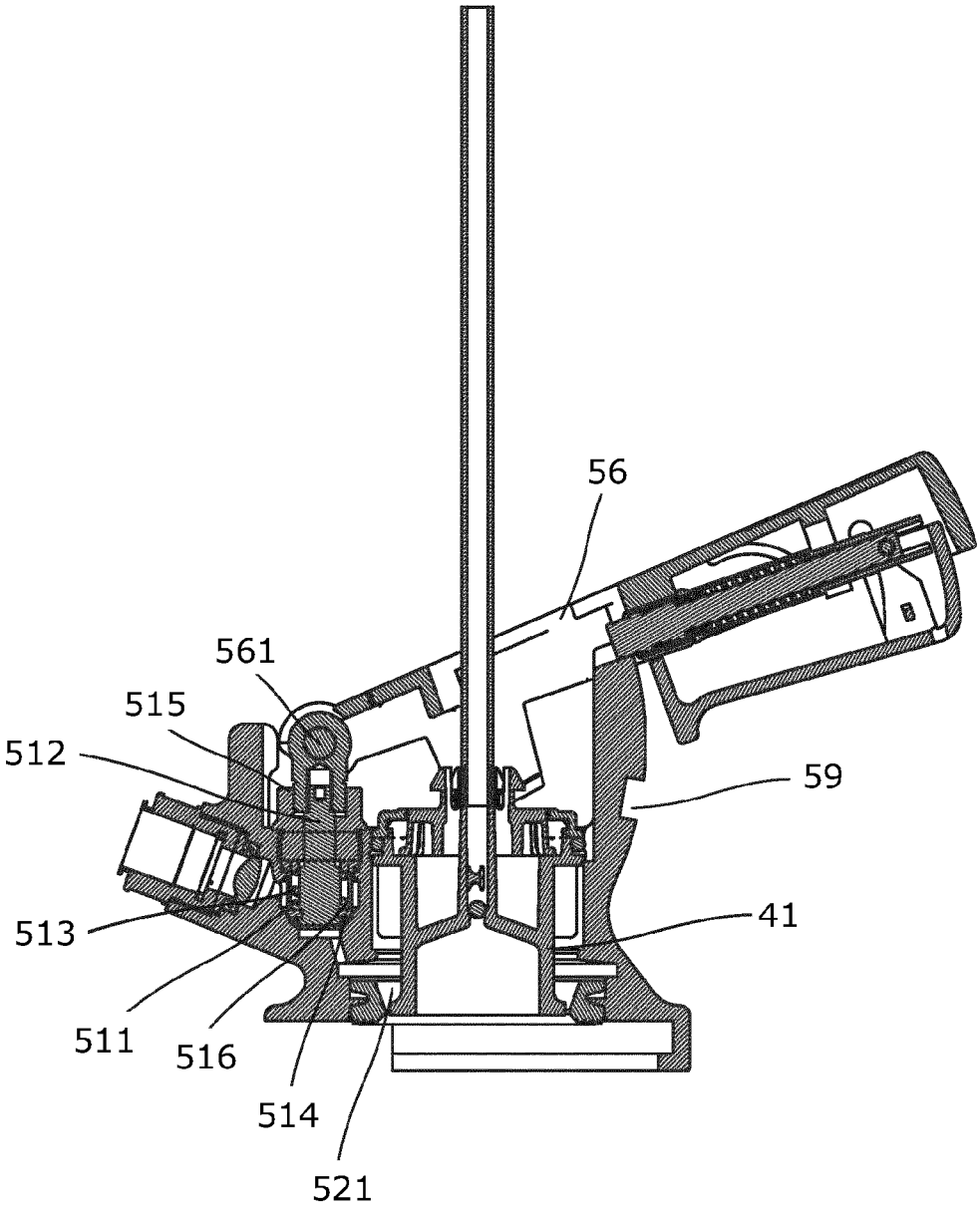
FIGS. 3*a* and 3*b* show different embodiments of a replaceable connection unit arranged in a dispense head with the activation handle in a deactivated position.
Figure 3B:
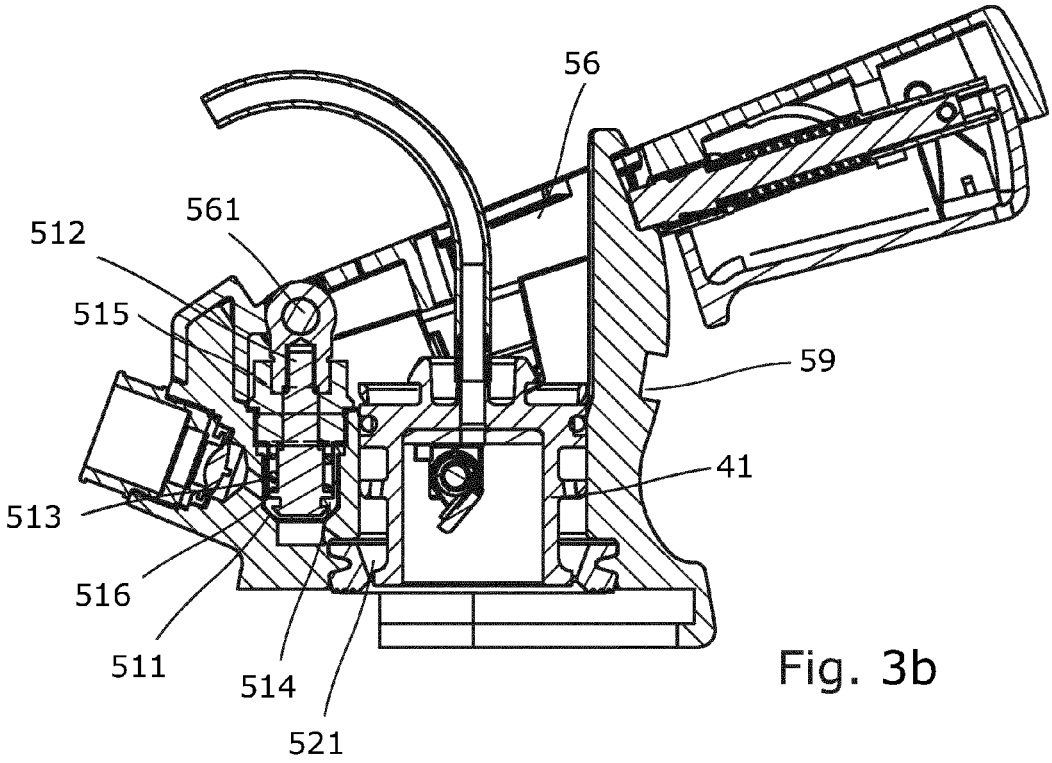
Figure 4A:
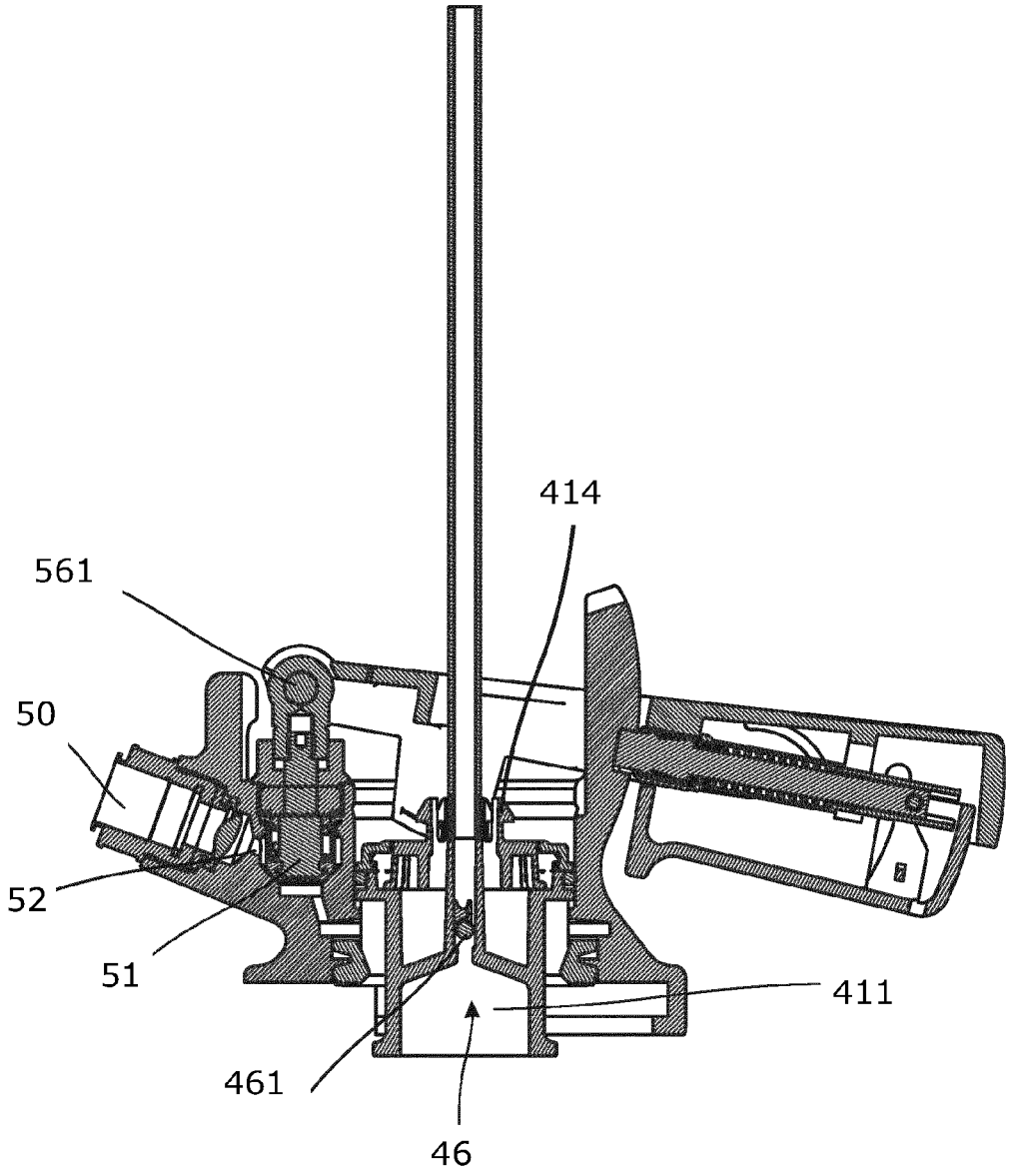
FIG. 4*a* shows an embodiment of a replaceable connection unit arranged in a dispense head with the activation handle in an activated position.
Figure 4B:
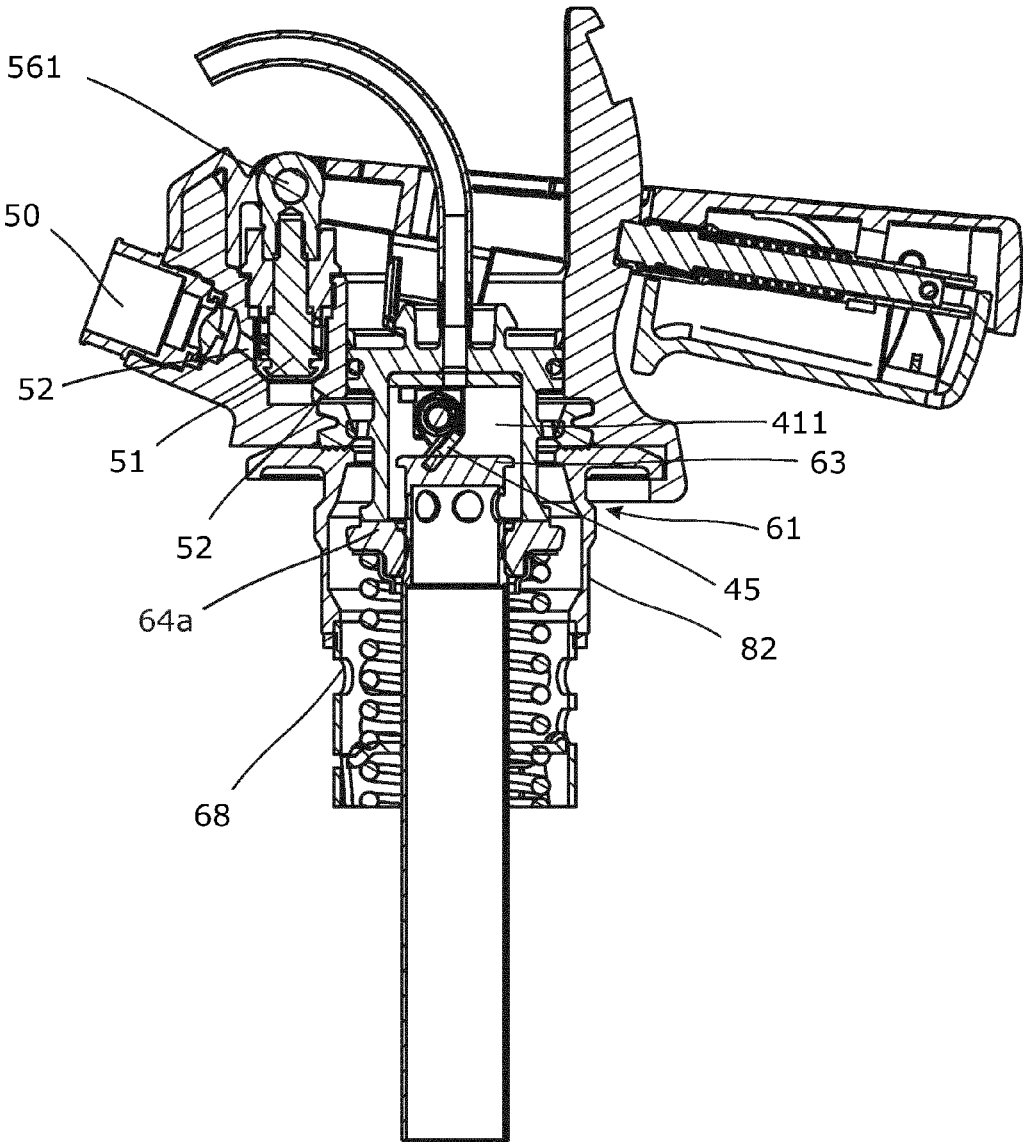
FIG. 4*b* shows a dispense head with the activation handle in an activated position while connected with an extractor tube, wherein another embodiment of a replaceable connection unit is arranged in the dispense head.

The dispense head further comprises an activation handle 56 pivotally mounted at a pivot point 561 at an upper part of the dispense head housing. The activation handle is movable between a first position as shown in FIG. 1, a second position as shown in FIGS. 3*a* and 3*b*, also denoted as the deactivated position, and a third position denoted as the activated position as shown in FIGS. 4*a* and 4*b*.

Figure 2:
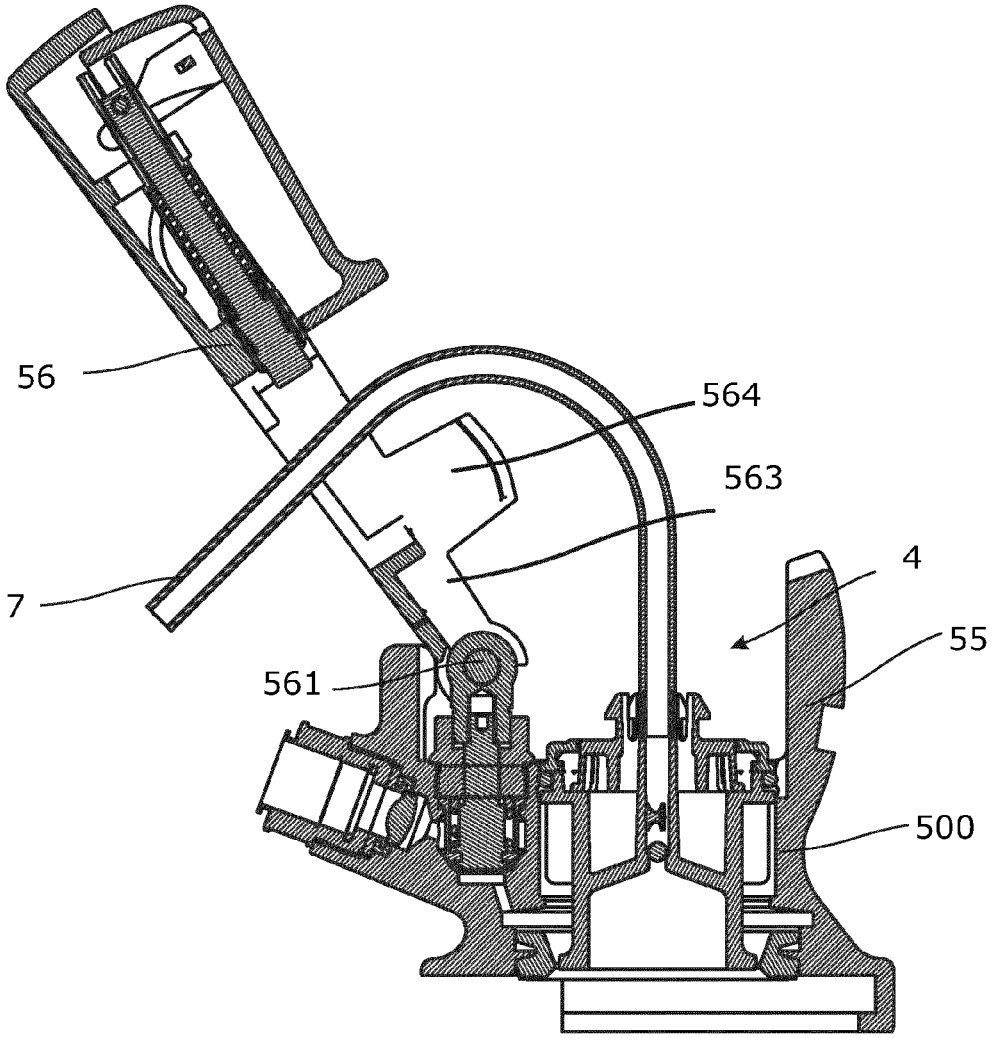
FIG. 2 shows the dispense head wherein the replaceable connection unit is arranged in a bore thereof.

Furthermore, the dispense head comprises a gas inlet 50 and a gas valve 51. The gas inlet is a conventional gas inlet for supplying pressurised gas, such as CO2 or other suitable gases, to the beverage dispensing system. The gas inlet 50 and the gas valve 51 are fluidly connected by a gas bore 52 extending from the gas inlet to a space 521 provided between the dispense head housing and an outer periphery of a hollow piston member 41, as shown in FIGS. 3*a* and 3*b*. The gas valve is arranged in the dispense head housing in a valve bore 511. The gas valve 51 comprises a nut 515 arranged around a valve piston 512 movable in an axial direction, a spring member 513 arranged around the valve piston and extending between a projection 516 in a bottom part of the valve piston and the nut, and a valve gasket 514 arranged around a lower part of the valve piston. The valve gasket 514 may for instance be a bellow gasket or other kind of seal known to the person skilled in the art. The valve gasket 514 is adapted to surround the lower part of the valve piston and the spring member 513, thereby sealing the movable parts of the gas valve, so that only the gasket is in direct contact with the gas flow. Hereby, a hygienic solution of a gas valve is obtained. The end of the valve piston, opposite to where the gasket is arranged, is pivotally connected with the activation handle, whereby the valve piston can be axially displaced by the activation handle. The valve piston is pushed towards a bottom of the valve bore by the spring member 513 to block the gas bore and provide a gas-tight seal. The gas valve acts as a control valve regulating the fluid communication between the gas inlet and the space 521. When in the closed position as shown in FIG. 2, the fluid communication between the gas inlet and the space 521 is blocked by the gas valve. The opening of the gas valve will be further described in the following.

In the following, the design and functionality of the replaceable connection unit 4 will be described with reference to FIGS. 1-5*b*. The connection unit is comprised by a dispensing line 7 connected to a hollow cylindrical piston member 41. The hollow piston member 41 defines a fluid channel 411 extending from a first and open end 412 thereof to a second end 413 connected to the dispensing line. At the second end of the hollow piston member, a protrusion 414 encircling the dispensing line is arranged. An upper part 415 of the protrusion is flanged outwards to provide a connection for the activation handle, as will be described later on. Towards the second end, the hollow piston member is flanged outwards to provide a guiding surface 416*a*. In the guiding surface, a seal 418, such as an O-ring, is arranged in an exterior groove. Substantially in a middle portion of the hollow piston member, another guiding surface 416*b* is provided on a second protruding part of the hollow piston member 41. At the first end 412, the hollow piston member is also flanged outwards to provide a larger piston area 417 for transferring an opening force applied via the activation handle to the movable valve member 64*a*.

In use, the hollow piston member of the replaceable connection unit is inserted into a bore in the dispense head housing. The bore has a diameter substantially equal to the outer diameter of the guiding surfaces 416*a*, 416*b* of the hollow piston member 41. When arranged in the bore, the hollow piston member is movable in an axial direction, and a space 521 is defined between the dispense head housing and the hollow piston member. The seal 418 provides a fluid-tight connection between the dispense head housing and the hollow piston member and seals off the space 521 in the upwards direction.

When inserting the hollow piston member into the dispense head, the hollow piston member and part of the dispensing line are first taken through an opening 562 in the activation handle 56. Subsequently, a gripping element 563 pivotally mounted to the dispense head housing as shown in FIG. 1 is pivoted towards the activation handle 56 to be received in the activation handle as shown in FIG. 2, whereby the opening 562 is substantially blocked. When received in the activation handle, two protruding legs 564 of the gripping element extend in a direction substantially perpendicular to the activation handle. Subsequently, the hollow piston member is inserted into the bore of the dispense head housing. The hollow piston member may also be inserted into the bore before the gripping element is received in the activation handle. When the activation handle is moved into the second position, the protruding legs 564 enter into engagement with the outwardly flanged upper part 415 of the protrusion of the replaceable connection unit. By moving the activation handle from the second position towards the third and activated position, the legs 564 push the hollow piston member 41 in the axial direction towards the dispensing valve 61. When moving the activation handle in the opposite direction, the engagement between the legs and the protrusion 414 transfers a pulling force to the hollow piston member causing the hollow piston member to move in an axial direction away from the dispensing valve.

Figure 9A:
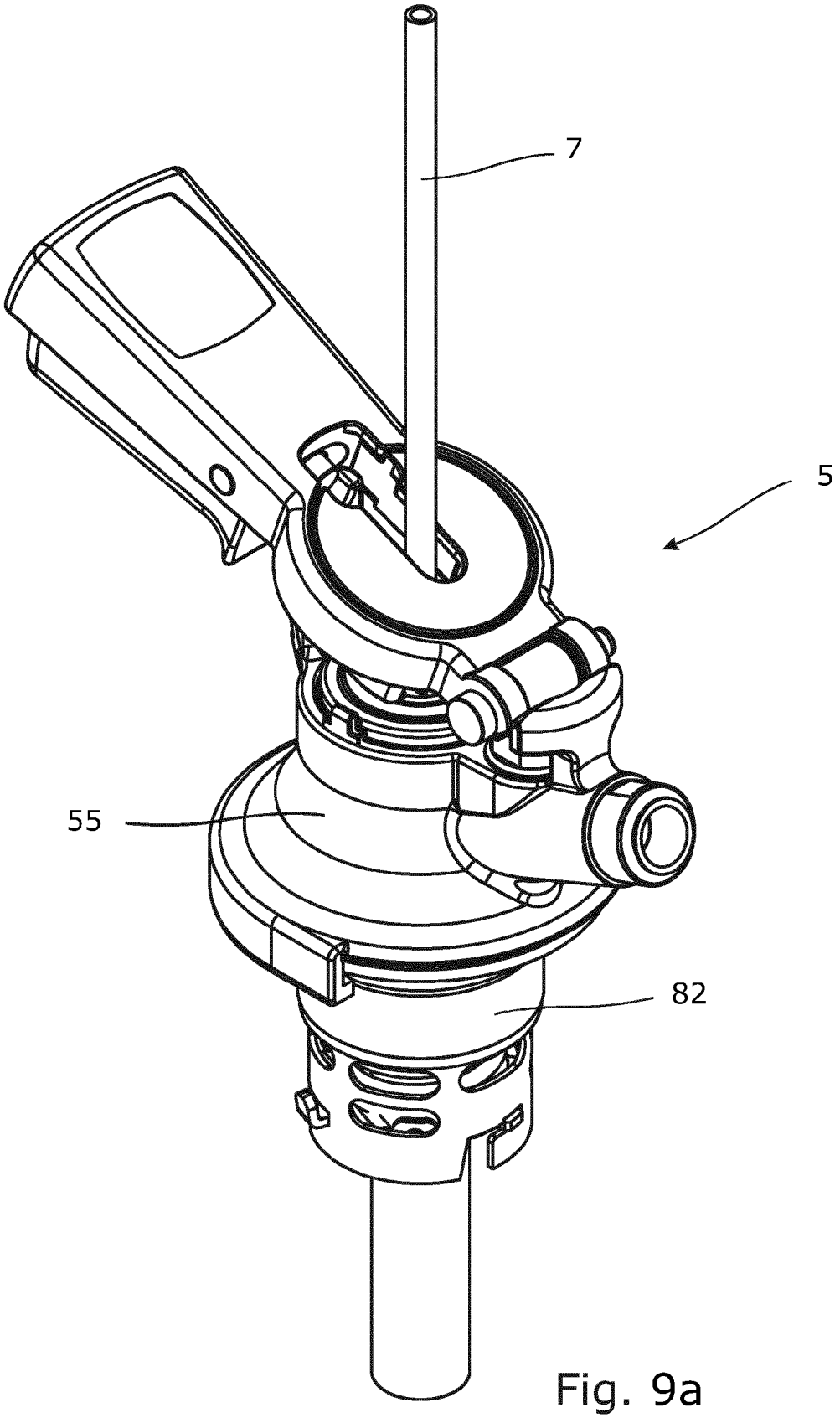
FIG. 9*a* shows the embodiment of FIG. 1 in perspective.
Figure 9B:
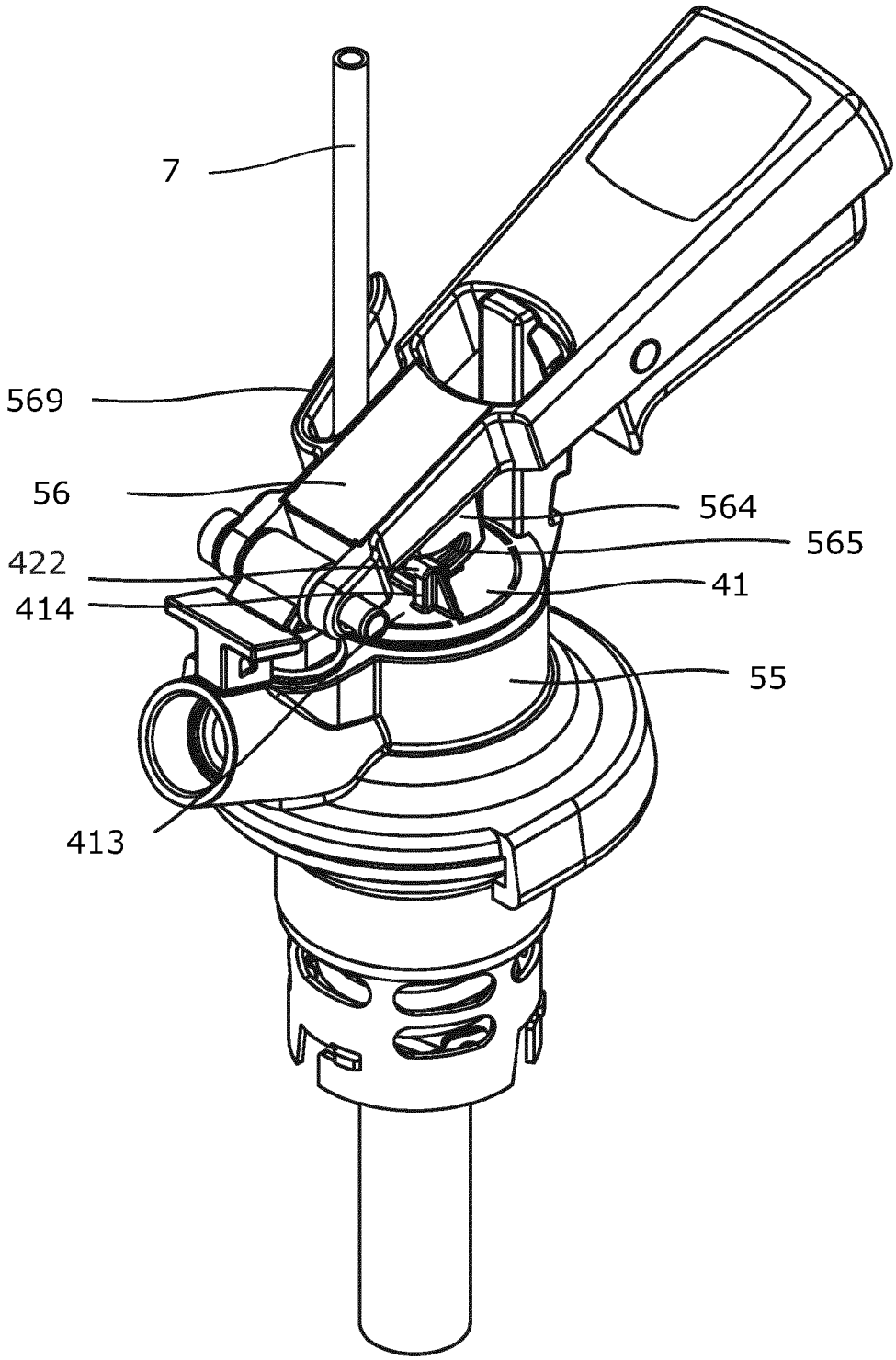
FIG. 9*b* shows a dispense head wherein the dispensing line is connected to a clip on a side of the activation handle.

FIG. 9*b* shows another embodiment wherein the hollow piston member 41 is inserted into the dispense head housing 55. In this embodiment, the activation handle comprises a protruding leg 564 adapted to receive a protrusion 414 extending from a second end 413 of the hollow piston member. The protruding leg comprises a groove wherein a head 422 of the protrusion 414 is received. Hereby, the hollow piston member is connected to the activation handle 56 and the hollow piston member may be moved in the axial direction. Further, the hollow piston member and the dispensing line 7 are not taken through an opening in the activation handle. Instead, the hollow piston member is inserted directly into the dispensing head housing by pivoting the activation handle to the left when regarded as illustrated in FIG. 9*b*. When the activation handle is subsequently moved back to the position shown in FIG. 9*b*, the head 422 of the protrusion 414 is received in the groove 565 of the protruding leg 564. The dispensing line 7 extending from the second end 413 of hollow piston member is secured in a holding clip 569 provided on the activation handle 56. FIGS. 4*a* and 4*b* show the activation handle and the hollow piston member in an activated position. In the activated position, the hollow piston member pushes the movable valve member out of engagement with the narrowing upper part of the housing and the outwardly protruding flange 631 on the stationary valve member. Hereby, the inner space of the beverage container is no longer sealed off, and the fluid channel 411 defined by the hollow piston member is in fluid communication with the chamber 83 defined by the housing 82 and the skirt 65 of the extractor tube. Further, the chamber 83 is in fluid communication with the space 521 defined between an outer periphery of the hollow piston member and the dispense head housing.

Further to opening the beverage container, the movement of the activation handle into the activated position has the functionality of bringing the gas valve into an open position. The gas valve may, however, only be brought into the open position when the dispense head is connected to the outwardly extending flange 821 of the housing 82 of the beverage container, as will become obvious from the following description. When the dispense head with the inserted hollow piston member is connected to the housing and the activation handle is moved into the activated position, the hollow piston member is pushed against the movable valve member, whereby the movable valve member is axially displaced downwards. The spring member 66 acts on the movable valve member in the opposite upwards direction, and the tension of the spring is thus increased. The tension in the spring member 66 causes the hollow piston member, the activation handle and the valve piston of the gas valve to be pressed slightly upwards. Because one end of the activation handle is maintained in its position by a groove 59 in the dispense head housing, the end of the activation handle pivotally connected to the valve piston is forced upwards, and consequently the valve piston is forced upwards. The valve piston is, however, only pushed upwards if the spring force of the spring member 66 in the extractor tube is sufficient to overcome the spring force of the spring member 513 in the gas valve. In an alternative embodiment, the displacement of the movable valve member is prevented from further downward movement at some distance from the top of the housing, e.g. by a physical obstruction, the spring member reaching a specific degree of compression or other means obstructing further displacement. By the movable valve member being prevented from moving downwards, the activation handle, connected to the hollow piston member abutting the movable valve member, provides a lever for moving the valve piston in an upwards direction. When the valve piston is forced upwards in the axial direction away from the bottom of the valve bore, the gas valve opens. When the gas valve is open, fluid communication is provided between the gas inlet and the space 521. When the activation handle is moved back to the deactivated position, the valve piston is pushed towards the bottom of the gas bore by the spring member 513 to close the gas valve.

During operation of the dispensing system, the activation handle being in the activated position, a gas from a gas supply 2 is supplied via the gas inlet and the gas bore to the space 521 and the chamber 83. From the space 521, gas is supplied to the top of the beverage container via openings 68 in the skirt of the extractor tube. When a dispensing tap 9 connected to the dispensing line is opened, beverage in the beverage container is displaced by the supplied gas. The gas causes the beverage at the bottom of the beverage container to flow through the riser via a number of fluid openings 67 in the stationary valve member and into the fluid channel 411 of the hollow piston member and further into the dispensing line. When the dispensing tap is closed, beverage can no longer flow out of the beverage container, and a state of equilibrium is established in the beverage dispensing system. By the hollow piston member being displaced to surround the riser, in the activated position, beverage flows directly from the riser and into the replaceable connection unit. Primarily, the beverage container, the riser and the replaceable connection unit of the beverage dispensing system are thus in contact with the beverage. During normal use, the beverage is not in contact with the dispense head housing or other part of the dispense head, thereby reducing the need for cleaning dispense head.

The hollow piston member comprises a mechanism with the functionality of preventing reuse of the replaceable connection unit and keeping beverage from spilling out of the dispensing line when removed from the beverage dispensing system. The replaceable connection unit is designed for single-use only to reduce the need for service and cleaning of the beverage dispensing system, especially the dispensing line. Different embodiments of the mechanism prevent reuse of the replaceable connection unit by blocking the fluid channel and/or changing the geometry of the hollow piston member will be described in the following. In general, the mechanism is activated when the hollow piston member is moved from the activated position to the deactivated position.

Figure 5A:
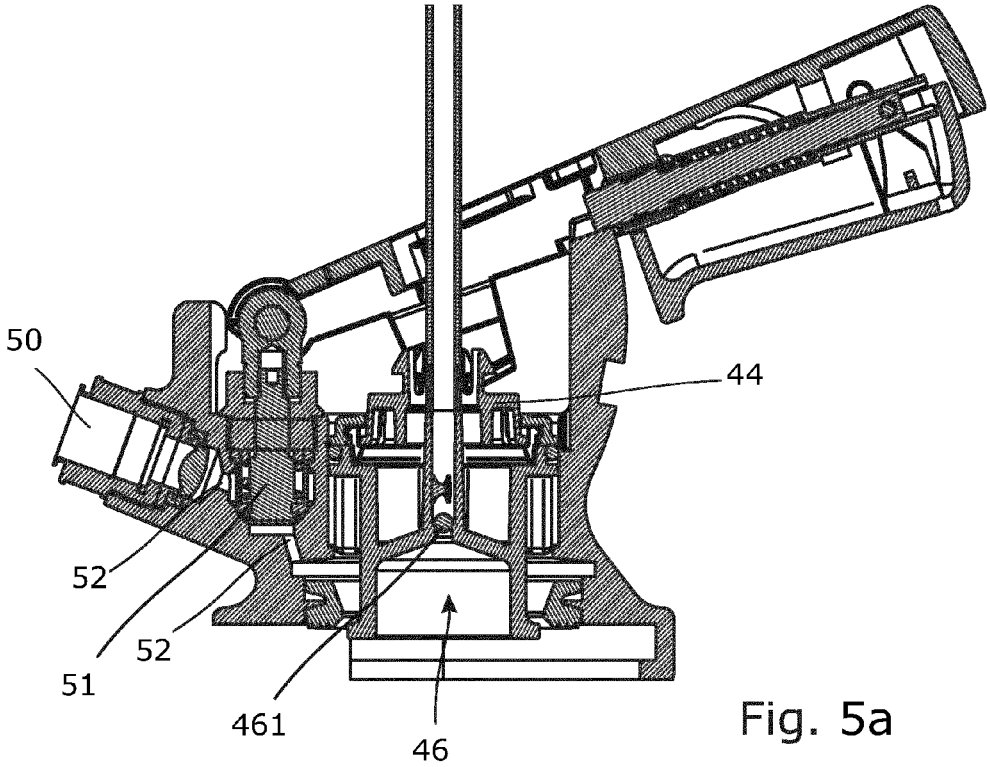
FIG. 5*a* shows the dispense head in a deactivated position with an insert of the replaceable connection unit in an extended position.
Figure 6A:
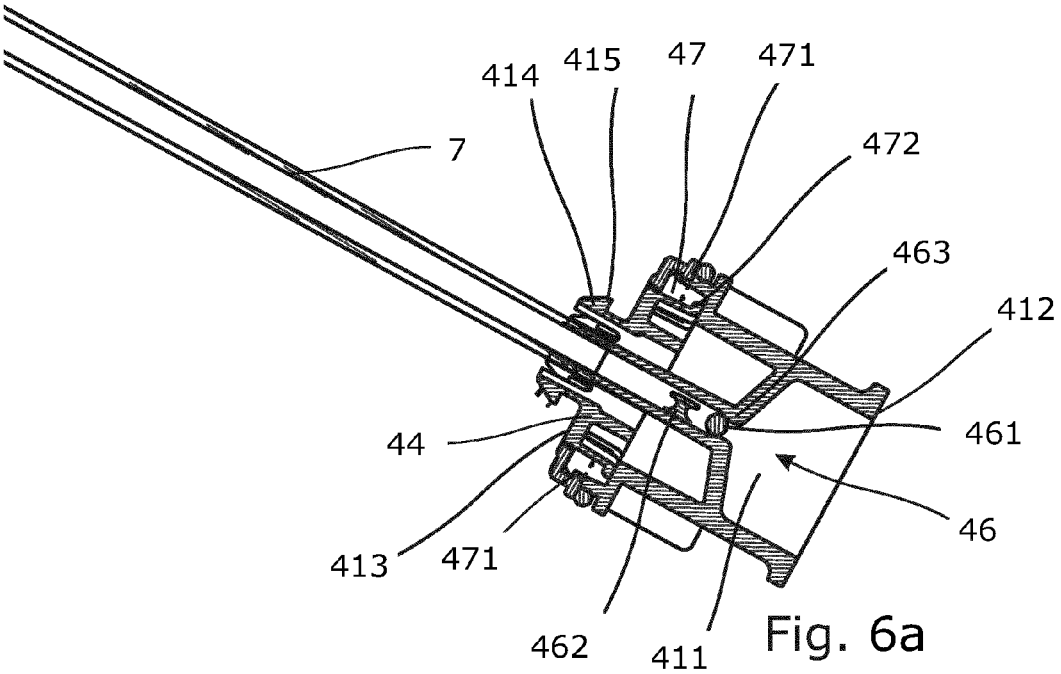
FIGS. 6*a* and 6*b* show different embodiments of a replaceable connection unit.
Figure 14:
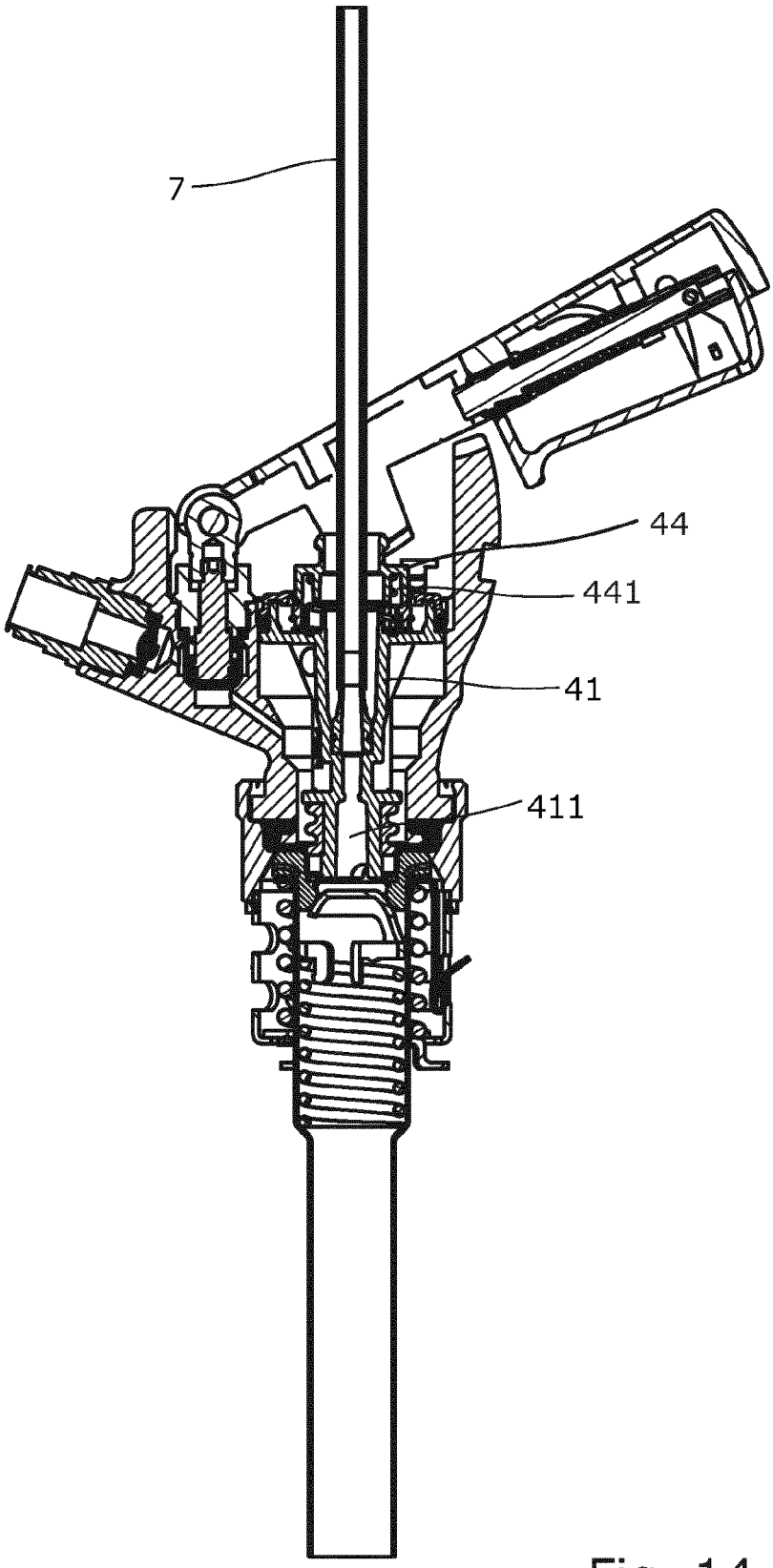
FIG. 14 shows a dispense head in a deactivated position with a prolonged hollow piston member.

In one embodiment, the hollow piston member comprises an axially displaceable insert 44, as shown in FIGS. 5*a* and 6*a*. The insert is arranged concentrically in relation to the hollow piston member and displaceable in a direction away from the first end of the hollow piston member. The insert 44 encircles the fluid channel 411 and the dispensing line and comprises the protrusion 414 described earlier. The insert is arranged in a bore 47 defined by a circumferential wall 471 protruding at the second end of the hollow piston member. The insert has an outer diameter corresponding to an inner diameter of the bore. The insert is displaceable in the bore and connected with the hollow piston member by a concentric rim 472 protruding from the insert at an end thereof. The rim engages one of a first and a second recess in the circumferential wall encircling the bore 47. When the insert is displaced in a direction away from the first end of the hollow piston member, the rim is removed from engagement with the first recess and enters into engagement with the second recess. Due to the geometry of the first and second recesses, the insert may only be moved in one direction. The first recess has a side face inclining towards the second recess, whereby the rim may be pulled out of engagement with the first recess. When the insert is displaced and the rim enters into engagement with the second recess, the insert is locked in an extended position. Hereby, the hollow piston member has been permanently prolonged. FIG. 14 shows another embodiment of the hollow piston member further comprising a spring member 441 adapted to push the displaceable insert 44 in a direction away from the first end of the hollow piston member, when the activation handle is moved from the activated position to the deactivated position.

In use, the protrusion 414 is connected with the activation handle, and when the activation handle is moved from the activated position to the deactivated position, the insert is displaced, thereby providing a permanent prolongation of the insert as shown in FIG. 5*a*. If the user subsequently tries to reconnect the hollow piston member with the beverage container by moving the activation handle from the deactivated position to the activated position, the activation handle cannot be locked in the activated position due to the prolongation of the hollow piston member. Hereby, reuse of the hollow piston member, i.e. the replaceable connection unit, is prevented.

To prevent back flow of beverage from the dispensing line connected to the hollow piston member, the hollow piston member may further comprise a check valve 45, 46 arranged in the fluid channel 411. In the embodiment shown in FIGS. 5*a* and 6*a*, the check valve 46 is comprised by a ball 461, a valve seat 463 provided by a narrowing part of the fluid channel, and a restriction element 462. When beverage flows from the beverage container towards the dispensing tap, the ball is pushed towards the restriction element, whereby beverage may flow freely as shown in FIG. 4*a*. When back flow occurs, e.g. when the connection unit is disconnected from the beverage dispensing system, the ball is pushed against the valve seat 463 to block the flow as shown in FIG. 5*a*. As shown in FIG. 14, the hollow piston member may also be constructed without a check valve 45, 46. Whether a check valve is required may depend on specific system requirements.

Figure 5B:
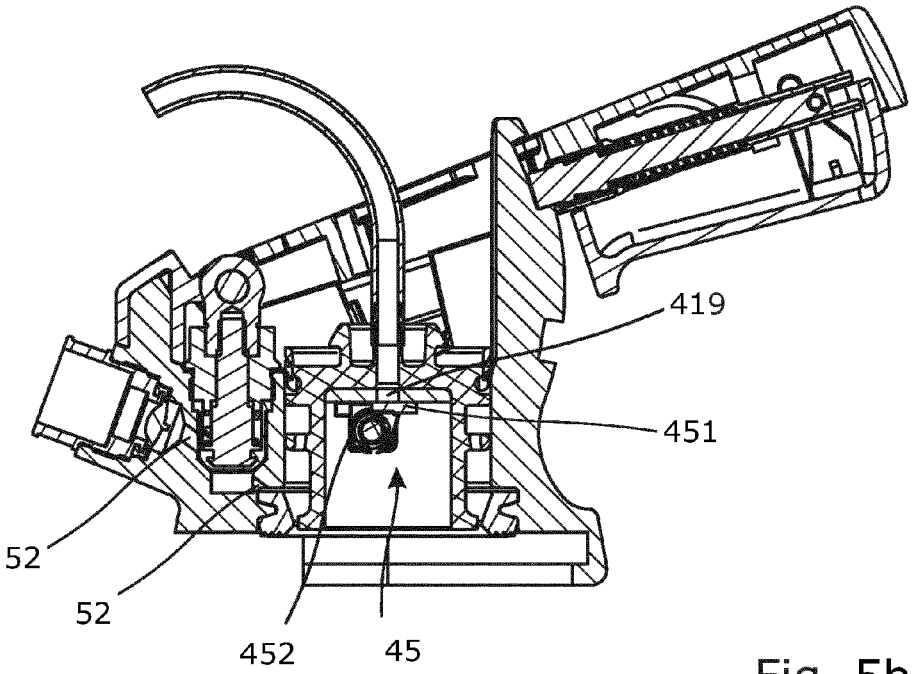
FIG. 5*b* shows the dispense head in a deactivated position with a check valve of the replaceable connection unit being activated.
Figure 6B:
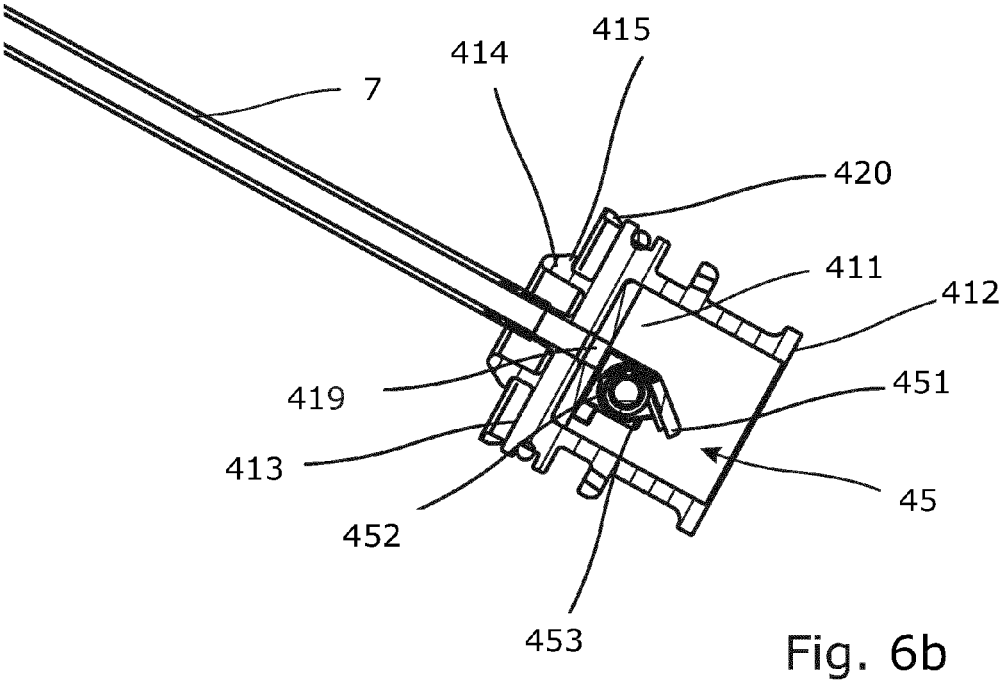

FIG. 6*b* shows yet another embodiment of the replaceable connection unit comprising a check valve 45 arranged in the fluid channel 411 and adapted to block a fluid flow path through the fluid channel upon activation. The check valve comprises a pivotally mounted blocking member 451 and a preloaded spring 452 connected to the blocking member. Upon activation of the check valve, the blocking member is rotated by the spring to block the fluid channel extending through the hollow piston member. Before the hollow piston member is inserted into the dispense head and moved into the activated position, the blocking member is releasably secured in an open position by a fixation element. When the piston is pushed into the activated position by the activation handle, the blocking member in the open position collides with the stationary valve member, as illustrated in FIG. 4*b*. The collision with the stationary valve member will cause the fixation element to rupture, leaving the blocking member in an unsecured state—free to rotate. However, the confined space, especially the stationary valve member, will prevent the blocking element from rotating into a closed position wherein the fluid channel of the hollow piston member is blocked. By the blocking member being pushed against the stationary valve member, the blocking member may be rotated slightly in a counter clockwise direction when regarded in the perspective shown in FIG. 4*b*. When the hollow piston member is subsequently moved in the axial direction away from the stationary valve member, the rotation of the blocking member is no longer restricted by the stationary valve member, and the blocking member is rotated by the preloaded spring into the closed position, as shown in FIG. 5*b*. In the closed position, the blocking member is pushed against an inlet 419 of a narrow part of the through-going fluid channel 411 by the spring.

In one embodiment, the replaceable connection unit further comprises a use-indicator indicating if the replaceable connection unit has been connected to a beverage container. In the embodiment shown in FIG. 6*b*, the use-indicator is a circumferential rim 420 releasably connected to the second end of the hollow piston member, so that the circumferential rim breaks off when the hollow piston member is moved in an axial direction inside the housing of the dispense head. The embodiment shown in FIG. 6*a* may comprise a use-indicator constituted by one or more elements (not shown) connected to an outer surface of the circumferential wall 471 protruding at the second end of the hollow piston member. The elements enlarge the outer diameter D of the hollow piston member, and when the hollow piston member is moved into the activated position as shown in FIG. 4*a*, the elements collide with the dispense head housing. Hereby the elements break off from the outer surface of the circumferential wall 471.

Figure 12:
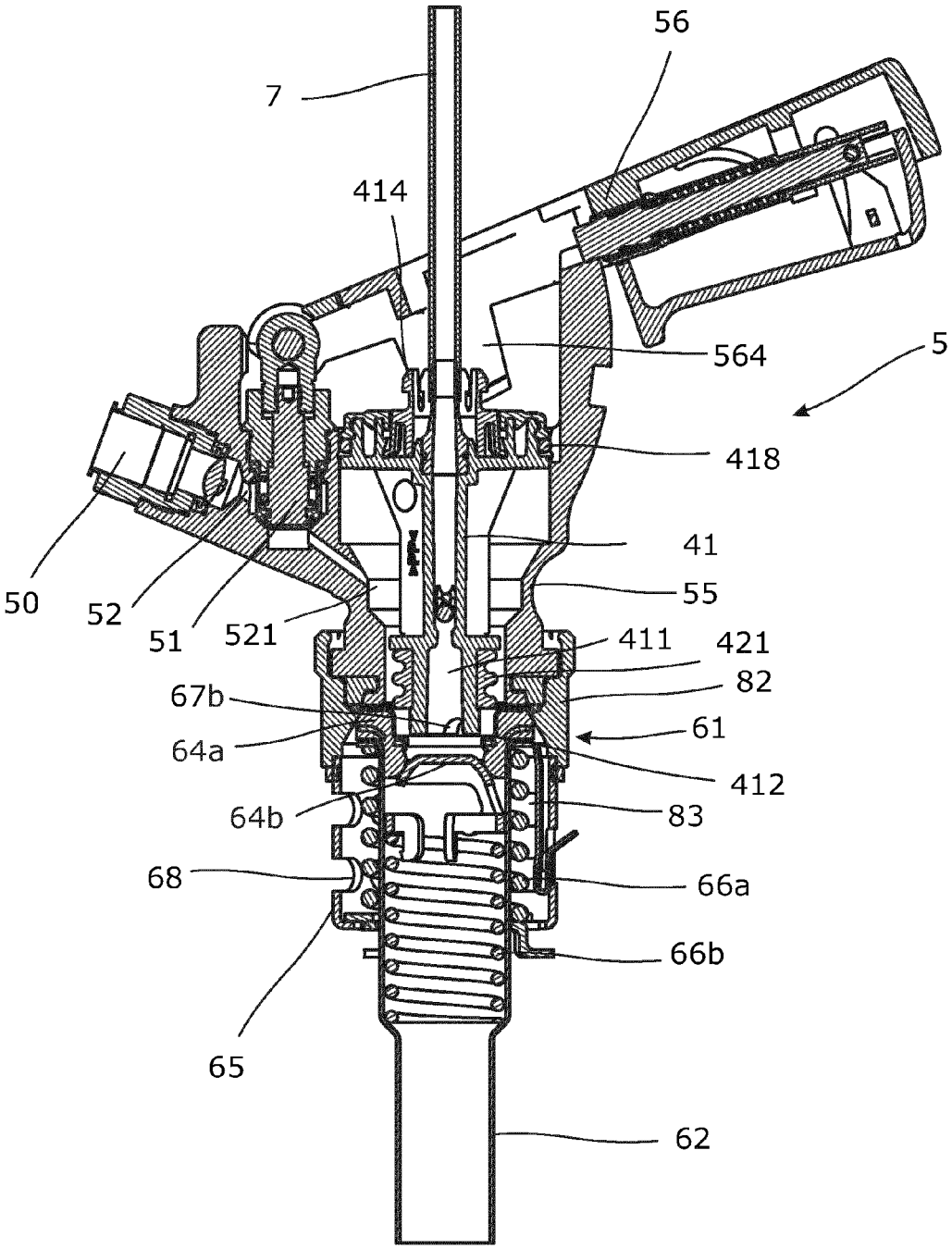
FIG. 12 shows the representation of FIG. 11 in cross-section.
Figure 13:
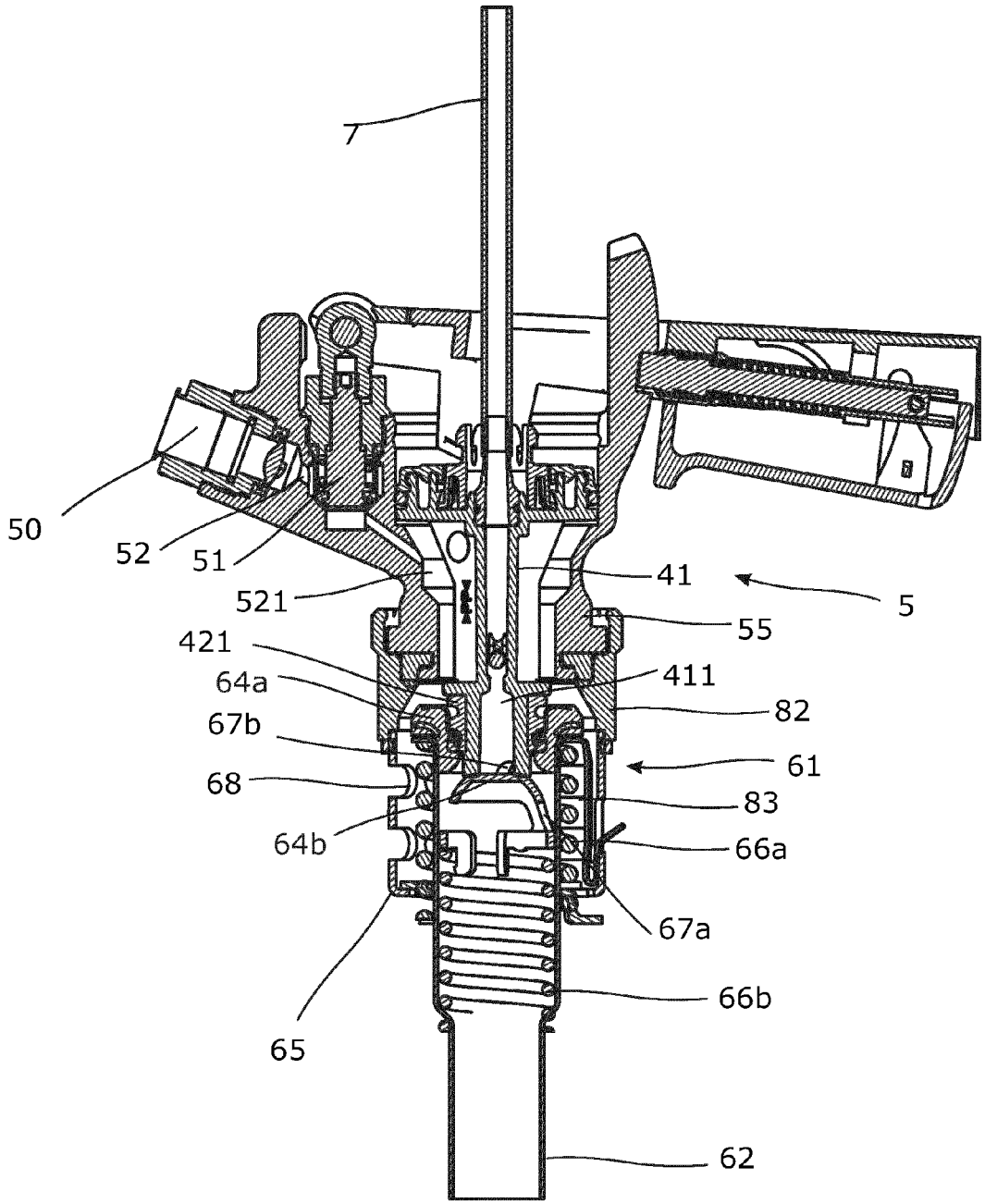
FIG. 13 shows the embodiment of FIG. 10, with the dispense head connected to the extractor tube and with the activation handle in an activated position.

FIGS. 10-13 show an alternative embodiment of a beverage dispensing system 1. This system comprises a bayonet connection for connecting the dispense head 5 to the housing 82 connected with the beverage container (not shown in FIGS. 10-13). Due to the different type of connection between the dispense head 5 and the housing 82, the dispensing head housing 55 and the hollow piston member 41 have a geometry that differs from the embodiments described above. In terms of functionality, the different embodiments are, however, very similar, and the following description will primarily focus on the features of the present embodiment that differ from the features of the previously described embodiments. The dispensing head 5 comprises a gas inlet 50 fluidly connected with a space 521 provided between the dispense head housing 55 and an outer periphery of the hollow piston member 41. A gas valve 51, similar to the gas valve described earlier, is provided to control the flow of gas between the gas inlet and the space 521. The hollow piston member 41 is connected to the activation handle via a protrusion 414 extending from a second end of the hollow piston member. The hollow piston member comprises a packing 421 encircling the hollow piston member adjacent the first end 412. In FIG. 12, the activation handle 56 and the hollow piston member 41 are in a deactivated position, and consequently the gas valve and the dispensing valve 61 are closed. In the embodiment shown in FIGS. 12-13, the dispensing valve comprises a first movable valve member 64*a* and a second movable valve member 64*b*. Each of the movable valve members is spring-loaded by a first spring member 66*a* and a second spring member 66*b*, respectively. When the dispensing valve is closed, the first movable valve member 64*a* is pushed upwards towards a narrowing part of the housing 82 and at the same time the second movable valve member 64*b* is pushed against the first movable valve member 64*a*, thereby closing the dispensing valve 61. The first movable valve member 64*a* is connected with the top of the riser 62, and the first movable valve member and the riser move simultaneously in the longitudinal direction. In FIG. 13, the activation handle 56 and the hollow piston member 41 are in an activated position, and the dispensing valve and the gas valve are open. When the hollow piston member is in the activated position, the packing 421 abuts the first movable valve member 64*a*, and the first end 412 of the hollow piston member abuts the second movable valve member 64*b*. When the dispensing valve is open, the first movable valve member 64*a* together with the riser 62 are displaced downwards as shown in FIG. 13. Hereby, fluid communication is established between the gas inlet 50 and the interior of the beverage container (not shown in FIG. 13). The gas from the gas inlet flows via the gas bore 52, through the open gas valve 51, along the hollow piston member 41 via the space 521, through a chamber 83 defined by the housing 82, a skirt 65 and the riser 62, and into the beverage container through openings 68 in the skirt. At the same time, the second movable valve member is displaced downwards inside the riser, whereby the second movable valve member 64*b* no longer abuts the first movable valve member, as shown in FIG. 13. Hereby, the gas may push beverage up through the riser 62 past the second movable valve member 64*b* and into a fluid channel 411 defined by the hollow piston member. As the first end 412 of the hollow piston member abuts the second movable valve member, the beverage enters the fluid channel 411 through openings 67*b* in a lower region of the hollow piston member. The packing 421 arranged between the hollow piston member and the first movable valve member provides the necessary packing to separate the flow of gas into the beverage container from the flow of beverage out of the beverage container.

Although the invention has been described in the above in connection with preferred embodiments of the invention, it will be evident for a person skilled in the art that several modifications are conceivable without departing from the invention as defined by the following claims.

The invention claimed is:

1. A beverage dispensing system for dispensing beverage from a beverage container, the beverage dispensing system comprising:

a dispense head adapted to be connected to the beverage container and comprising:

a housing having a through-going bore, and an activation handle pivotally mounted to the housing and movable between at least a deactivated position and an activated position;

an extractor tube inserted in the beverage container and comprising a riser; and a replaceable connection unit adapted to be connected with the dispense head and comprising:

a hollow piston member removably insertable into the bore of the housing, and a dispensing line connected to the hollow piston member, whereby the hollow piston member is axially displaceable between a deactivated position and an activated position, by moving the activation handle, and when in the activated position, the hollow piston member fluidly connects, by a fluid channel, the extractor tube and the dispensing line to dispense beverage from the beverage container, wherein the hollow piston member has a first end and a second end and further comprises a use-indicator comprising a circumferential rim releasably connected to the second end of the hollow piston member, the use-indicator indicating, even when the beverage is not being dispensed, if the replaceable connection unit has been connected to the beverage container.

2. The beverage dispensing system according to claim 1, wherein the hollow piston member defines a fluid channel extending between the first end and the second end of the hollow piston member, and the hollow piston member comprises a protrusion protruding from the second end of the hollow piston member in an axial direction, the protrusion having a flange adapted to be connected with the activation handle of the dispense head.

3. The beverage dispensing system according to claim 2, wherein the activation handle further comprises a gripping element pivotally mounted to the housing, the gripping element comprising at least one protruding leg being adapted to receive the protrusion and entering into engagement with the hollow piston member.

4. The beverage dispensing system according to claim 1, wherein the hollow piston member comprises a mechanism preventing reuse of the replaceable connection unit by at least one selected from the group of actions consisting of: blocking the fluid channel and changing the geometry of the hollow piston member, the mechanism being activated when the hollow piston member is moved from the activated position to the deactivated position.

5. The beverage dispensing system according to claim 1, wherein the hollow piston member comprises a check valve arranged in the fluid channel, the check valve comprising a preloaded spring and a pivotally mounted blocking member, wherein the blocking member is rotated by the spring member when the check valve is activated by rupturing a fixation element.

6. The beverage dispensing system according to claim 1, wherein the hollow piston member comprises an axially displaceable insert connected with the second end of the hollow piston member, the insert being displaceable in a direction away from the first end of the hollow piston member and constituting the second end of the hollow piston member.

7. The beverage dispensing system according to claim 1, wherein the hollow piston member is made from a polymer material.

8. The beverage dispensing system according to claim 1, wherein the circumferential rim breaks off when the hollow piston member is moved in an axial direction in relation to the housing.

9. The beverage dispensing system according to claim 1, wherein the hollow piston member, when removably inserted into the bore, is enclosed by the housing of the dispense head.

10. The beverage dispensing system according to claim 1, wherein the activation handle comprises an opening having a minimum diameter (d) which is substantially equal to a maximum diameter (D) of the hollow piston member.

11. The beverage dispensing system according to claim 1, wherein the beverage dispensing head comprises:

a housing having a through-going bore; and an activation handle pivotally mounted to the housing and movable between at least a deactivated position and an activated position.

12. A method for connecting a replaceable connection unit to a beverage container of a beverage dispensing system, the beverage dispensing system having:

a dispense head adapted to be connected to the beverage container and having:

a housing having a through-going bore, and an activation handle pivotally mounted to the housing and movable between at least a deactivated position and an activated position, the activation handle comprises an opening having a minimum diameter (d) which is substantially equal to a maximum diameter (D) of a hollow piston member;

an extractor tube inserted in the beverage container and comprising a riser; and the replaceable connection unit adapted to be connected with the dispense head, the connection unit having the hollow piston member removably insertable into the bore of the housing, and a dispensing line connected to the hollow piston member, whereby the hollow piston member is axially displaceable between a deactivated position and an activated position, by moving the activation handle, and when in the activated position, the hollow piston member fluidly connects the extractor tube and the dispensing line to dispense beverage from the beverage container, wherein the hollow piston member has a first end and a second end and further comprises a use-indicator comprising a circumferential rim releasably connected to the second end of the hollow piston member, the use-indicator indicating, even when the beverage is not being dispensed, if the replaceable connection unit has been connected to the beverage container;

the method comprising the steps of:

connecting a dispense head to the beverage container, inserting a hollow piston member of the replaceable connection unit in a bore of the dispense head, connecting a gripping element extending from an activation handle to a protrusion provided on the hollow piston member by moving the activation handle from a first position to a second position, and moving the activation handle from the deactivated position to the activated position, whereby the hollow piston member is pushed against a spring-loaded movable valve member and into the beverage container.

13. A method for disconnecting a replaceable connection unit connected to a beverage container, of a beverage dispensing system, the beverage dispensing system having:

a dispense head adapted to be connected to the beverage container and having:

a housing having a through-going bore, and an activation handle pivotally mounted to the housing and movable between at least a deactivated position and an activated position, the activation handle comprises an opening having a minimum diameter (d) which is substantially equal to a maximum diameter (D) of a hollow piston member;

an extractor tube inserted in the beverage container and comprising a riser; and the replaceable connection unit adapted to be connected with the dispense head and having the hollow piston member removably insertable into the bore of the housing, and a dispensing line connected to the hollow piston member, whereby the hollow piston member is axially displaceable between a deactivated position and an activated position, by moving the activation handle, and when in the activated position, the hollow piston member fluidly connects the extractor tube and the dispensing line to dispense beverage from the beverage container, wherein the hollow piston member has a first end and a second end and further comprises a use-indicator comprising a circumferential rim releasably connected to the second end of the hollow piston member, the use-indicator indicating, even when the beverage is not being dispensed, if the replaceable connection unit has been connected to the beverage container;

the method comprising the steps of:

activating a check valve arranged in a fluid channel defined by the hollow piston member by moving the activation handle from a third position to a second position, breaking off the connection between the gripping element of the activation handle and the protrusion on the hollow piston member by moving the activation handle between the second position and a first position, and removing the hollow piston member from the bore of the housing.

* * * * *